US010247516B1

(12) United States Patent
Kennedy

(10) Patent No.: US 10,247,516 B1
(45) Date of Patent: Apr. 2, 2019

(54) RANGE FINDER DEVICE WITH CORRECTION RETICLE

(71) Applicant: Mickey McArthur Kennedy, Medina, OH (US)

(72) Inventor: Mickey McArthur Kennedy, Medina, OH (US)

( * ) Notice: Subject to any disclaimer, the term of this patent is extended or adjusted under 35 U.S.C. 154(b) by 0 days.

(21) Appl. No.: 15/732,728

(22) Filed: Dec. 22, 2017

(51) Int. Cl.
*F41G 1/467* (2006.01)
*F41G 3/08* (2006.01)
*F41G 3/06* (2006.01)

(52) U.S. Cl.
CPC ..... *F41G 3/08* (2013.01); *F41G 1/467* (2013.01); *F41G 3/06* (2013.01)

(58) Field of Classification Search
CPC . F41G 1/467; F41G 1/473; F41G 3/06; F41G 3/08; F41B 5/1492
USPC ..... 33/265; 124/87
See application file for complete search history.

(56) References Cited

U.S. PATENT DOCUMENTS 4,620,372 A * 11/1986 Goodrich ..... F41G 1/467 33/265
6,252,706 B1 * 6/2001 Kaladgew ..... F41G 3/06 359/399
7,162,806 B1 * 1/2007 Swiggart ..... F41G 1/467 124/87
7,743,518 B2 * 6/2010 Khoshnood ..... F41G 1/467 124/87
7,937,878 B2 * 5/2011 Sammut ..... F41G 1/473 42/122
8,065,807 B2 * 11/2011 Rucinski ..... F41G 1/467 124/87
8,286,871 B2 * 10/2012 Bay ..... F41G 1/467 235/404
8,316,551 B2 * 11/2012 Gorsuch ..... F41G 1/467 124/87
8,336,216 B2 * 12/2012 Samuels ..... F41G 1/467 124/87
8,893,423 B2 * 11/2014 Tubb ..... F41G 1/38 42/122
8,908,045 B2 * 12/2014 Stewart ..... H04N 5/225 348/169
9,310,173 B2 * 4/2016 Bay ..... F41G 1/35
9,377,272 B2 * 6/2016 Morrison ..... F41B 5/1492
9,568,278 B1 * 2/2017 Jordan ..... F41G 1/467
2005/0246910 A1 * 11/2005 Mowers ..... F41G 1/467 33/266
2009/0205239 A1 * 8/2009 Smith, III ..... F41G 1/38 42/122
2013/0133213 A1 * 5/2013 Gorsuch ..... F41G 1/467 33/265
2015/0241172 A1 * 8/2015 Roman ..... F41G 1/473 235/404
2016/0069643 A1 * 3/2016 Lyren ..... G09B 19/0038 345/589
2017/0284771 A1 * 10/2017 Roman ..... F41G 1/38

* cited by examiner

*Primary Examiner* — Alexander R Niconovich

(57) ABSTRACT

The disclosed subject matter relates to a range finder device with integrated aiming elements. These aiming elements can include, for instance, a view of a target or field of view including the target and a correction reticle. The range finder device can determine a distance to the target, which can be presented along with the aiming elements in an integrated fashion to, e.g., facilitate more accurate, more convenient, or improved aiming of a projectile device.

17 Claims, 8 Drawing Sheets

RANGE FINDER DEVICE WITH CORRECTION RETICLE

TECHNICAL FIELD

The present application relates generally to a range finder, which can determine a distance to the target, having a display that can present the distance and an integrated correction reticle.

BACKGROUND

In the domain of game hunting, target shooting, or similar, there exist countless types of arms, ammunition, and associated sighting devices. In many instances, particularly in the case of archery-based arms such as bows or crossbows, accurately aiming can be heavily dependent on a distance to the target.

BRIEF DESCRIPTION OF THE DRAWINGS

Numerous aspects, embodiments, objects and advantages of the present invention will be apparent upon consideration of the following detailed description, taken in conjunction with the accompanying drawings, in which like reference characters refer to like parts throughout, and in which.

DETAILED DESCRIPTION

OVERVIEW

Figure 1:
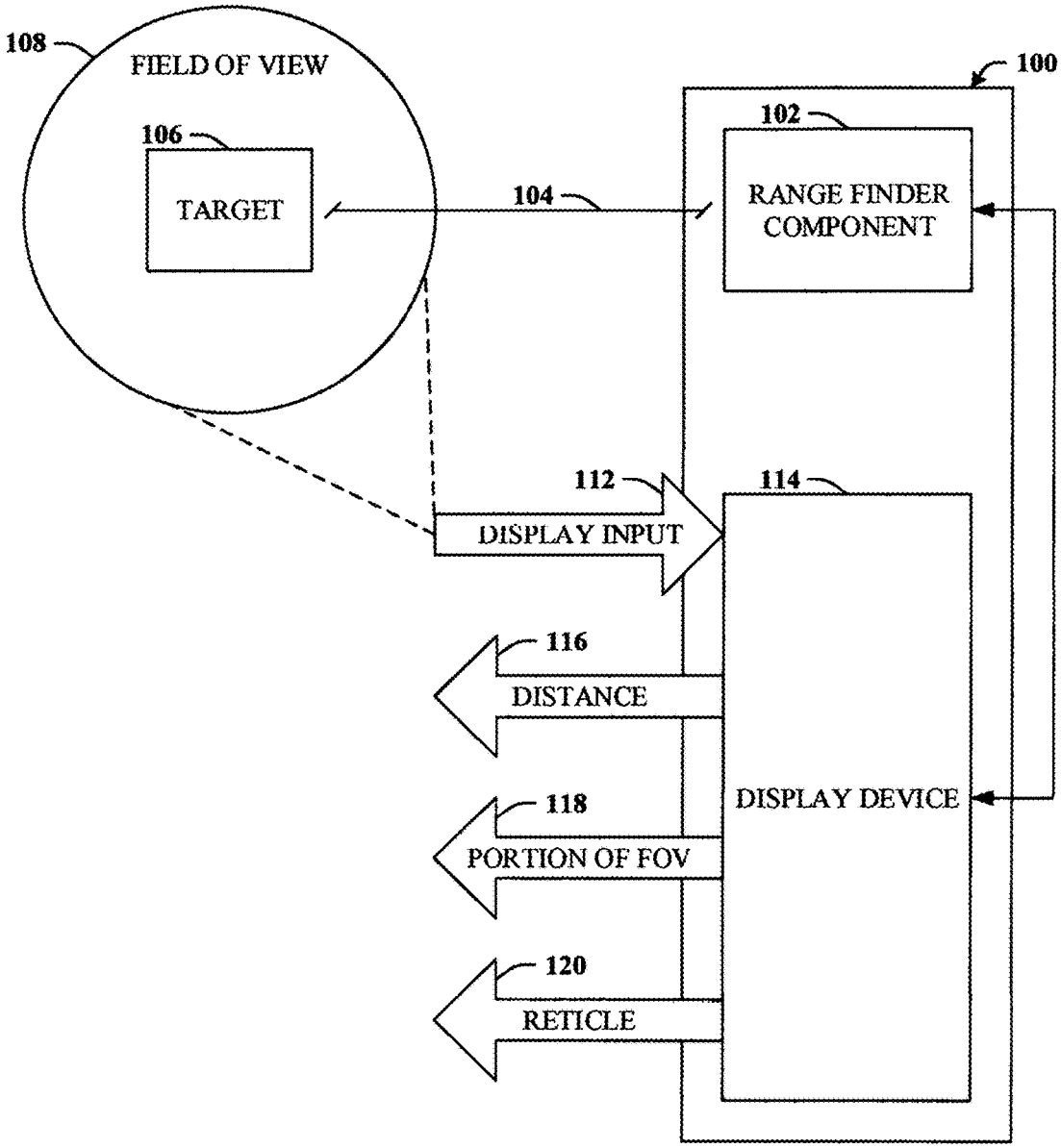
FIG. 1 illustrates a block diagram of an example Device that can provide an integrated range finder and correction reticle in accordance with one or more embodiments of the disclosed subject matter.

In the domain of game hunting, target shooting, or the like, there exist countless types of arms, ammunition, and associated sighting devices. In the case of archery-based arms such as bows or crossbows the velocity of the projected ammunition (e.g., a projectile) such as arrows or crossbow bolts is of relatively low velocity when compared to bullets or other high-velocity ammunition. Due at least in part to this typically lower velocity for arrows or bolts, factors such as distance to the target have more significant effects on the shooter's accuracy and or ability to hit the target over relatively short distances (e.g., less than about 30 meters) than for higher velocity projectiles. For high velocity projectiles, such effects (e.g., loss of altitude of the projectile due to gravity) are generally not significant until the distance to the target becomes relatively large (e.g., greater than about 100 meters).

For low velocity ammunition (e.g., arrows, bolts, etc.), small errors (e.g., a few meters) in estimating the distance to the target can result in a difference between hitting the target and missing. In fact, in the case of archery-based equipment, research indicates that the most often cited reason for missing a target is due to incorrectly estimating the distance to the target.

Range finder devices exist in the market place, which can be used to at least partially remedy certain difficulties of determining the distance to the target. However, other solutions have certain drawbacks. For example, other solutions typically require additional time, resources, or labor. Generally, a single user cannot concurrently operate a range finder and a bow, rifle, or other projectile device. Thus, additional preparation time is needed after identifying a target but before firing at the target, or another pair of hands or eyes is used (e.g., a "spotter"), one pair to determine the distance and the other pair to aim and shoot.

Additionally, reticles also exist in the market place, which can be used to at least partially remedy certain difficulties of determining the distance to the target. Some reticles rely on geometric principles to allow users to mentally calculate an aiming variable based on knowledge of a different aiming variable. For example, a skilled hunter or marksman who has knowledge of the size of a target can use that knowledge to estimate the distance to the target based on the geometric properties of the reticle. Once that distance is estimated, the reticle can be further used to aim accordingly. However, such involves a significant amount of mental processes that require additional time, are prone to error, and require accurate knowledge of the size of the target.

The disclosed subject matter relates to a range finder device with an integrated correction reticle and potentially other useful aiming elements. Such can increase the accuracy at hitting a desired target, and can also reduce the time, resources, or effort associated with obtaining increased accuracy. The device can also be simpler and more intuitive than other solutions, e.g., by removing unnecessarily complex or time-consuming operations typically associated with determining range and aiming; mitigating the complexity of learning and operating other equipment, and/or enabling a more consistent and uninterrupted aiming process. By providing an accurate distance to the target and a correction reticle in the same view, numerous targeting difficulties can be mitigated. For example, there is no need for a spotter or to lose time by swapping out equipment to accomplish the task of determining distance. Furthermore, there is no requirement to know in advance the size of the target, often a rough estimate in any event, or to perform the mental conversion steps that are prone to error or misjudgment. Rather, a user can simply take note of the distance and, based on the configuration of an associated firearm or other projectile device, use the reticle to make distance-based (or other) corrections in aiming at the target, which can be accomplished without significantly impacting the aiming motions or procedures.

EXAMPLE FEATURES OF SOME EMBODIMENTS

A device having a rangefinder that determines the distance to an object and presents the distance, e.g., on a liquid crystal display (LCD) or another optical device such as a scope or the like.

An adjustable reticle also presented on the LCD. The reticle can have variable designs such as a design that employs a mil-dot matrix. The reticle can physically overlay the LCD screen (or other optical device) or be generated and presented by the LCD screen electronically.

The LCD can be positioned at the rear of the device for viewing the range and zero point for launching a projectile toward an intended target.

With proper mounting bracket and adapters, this device can be used on substantially any type of projectile device having substantially any configuration.

Trajectory of projectile and impact point can be determined by variable points on the reticle. Such can be based on known settings or a zeroing configuration procedure.

EXAMPLE SYSTEMS

Various aspects or features of this disclosure are described with reference to the drawings, wherein like reference numerals are used to refer to like elements throughout. In this specification, numerous specific details are set forth in order to provide a thorough understanding of this disclosure. It should be understood, however, that certain aspects of disclosure may be practiced without these specific details, or with other methods, components, materials, etc. In other instances, well-known structures and devices are shown in block diagram form to facilitate describing the subject disclosure.

Referring now to the drawing, with reference initially to FIG. 1, range finder device 100 is depicted. Device 100 can provide an integrated range finder and correction reticle in accordance with one or more embodiments of the disclosed subject matter. Device 100 can be an archery-based sighting device such as for a bow or crossbow or any other suitable type of projectile device. Device 100 can include range finder component 102 and display device 110. Device 100 can comprise a processor and a memory that stores executable instructions that, when executed by the processor, facilitate performance of operations. Examples of said processor and memory, as well as other suitable computer or computing-based elements, can be found with reference to FIG. 7, and can be used in connection with implementing one or more of the systems, devices, or components shown and described in connection with FIG. 1 or other figures disclosed herein.

Range finder component 102 can be configured to determine distance 104 to target 106, e.g., in connection with hunting or target shooting. Distance 104 can be determined in any suitable units, such as yards, meters, feet, or the like. Display device 110 can be, or can include, an optics or optical device such as a scope, an electronic or computer-based display such as a liquid crystal display (LCD), or another suitable display device. In some embodiments, display device 110 can be configured to provide a heads up display (HUD) type representation.

Display input 112 can relate to field of view 108. Field of view 108 can represent a view of an environment that includes target 106. Typically, display input 112 will include visible light, however, it is understood that display input 112 can also relate to electromagnetic radiation (EM) outside of the human-visible spectrum, such as, e.g., infra-red light.

Display device 110 can be configured to present various display output 114. For example, display device 110 can present a first output representative of distance 104 to target 106, which is illustrated by reference numeral 116. As another example, display device 110 can present a second output that can be representative of a portion of the field of view 108 that includes target 106, which is illustrated by reference numeral 118. Advantageously, the same display presenting the first and second outputs (e.g., display device 110) can also present correction reticle 120. Correction reticle 120 can be configured to correct an aiming point based on the distance to the target or other suitable parameters. Additional detail and various non-limiting examples of correction reticle 120 are provided in connection with FIG. 3. Additional detail and various non-limiting examples of display output 114 are provided in connection with FIGS. 4 and 5.

Figure 2:
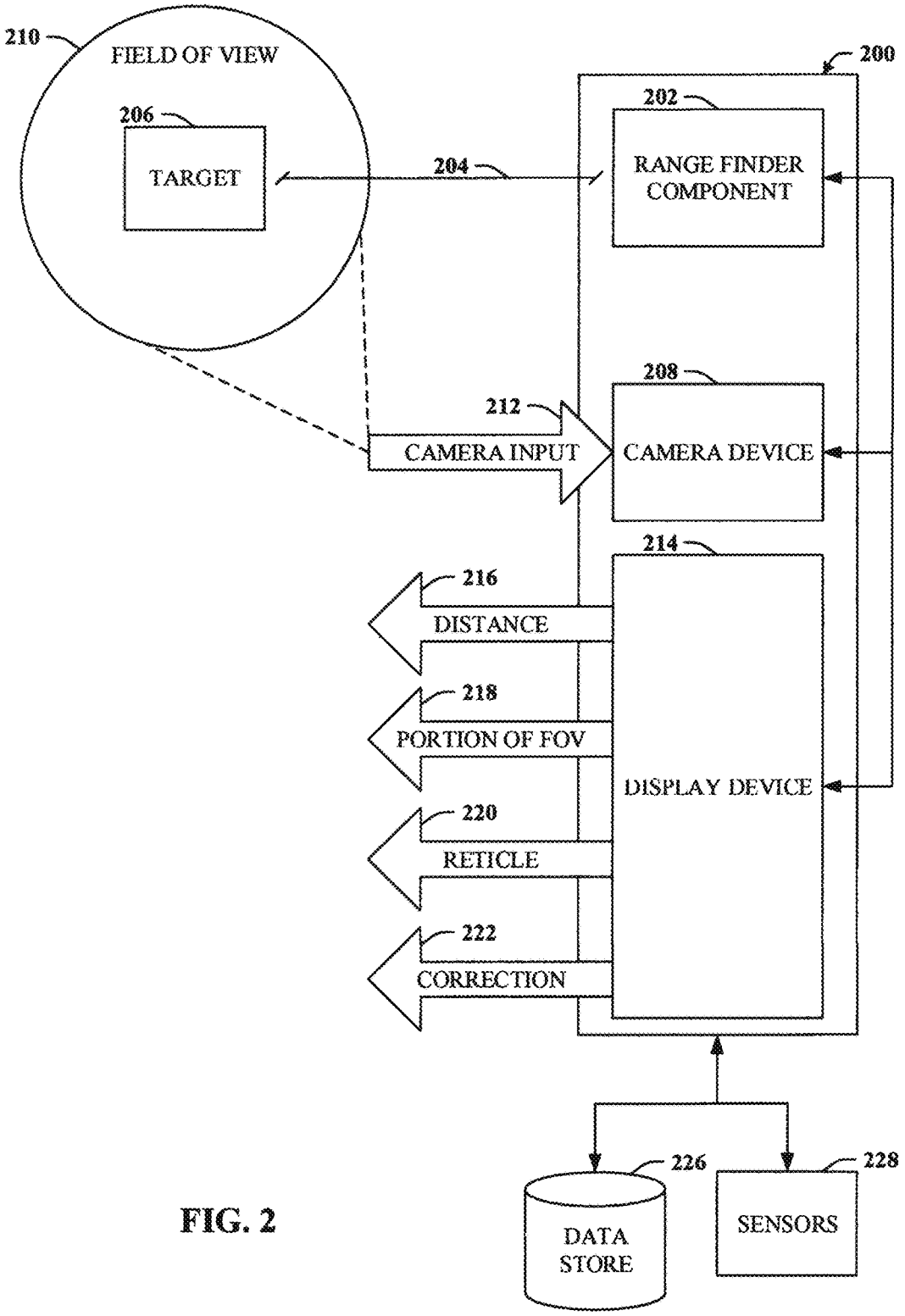
FIG. 2 illustrates a block diagram of an example Device that can provide additional aspects or elements in connection with an integrated range finder and correction reticle in accordance with one or more embodiments of the disclosed subject matter.

Turning now to FIG. 2, range finder device 200 is depicted. Device 200 can provide additional aspects or elements in connection with an integrated range finder and correction reticle in accordance with one or more embodiments of the disclosed subject matter. Device 200 can include all or a portion of devices, components, or other elements detailed in connection with FIG. 1. Repetitive description of like elements employed in other embodiments described herein is omitted for sake of brevity. For example, device 200 can include range finder component 202, camera device 208, and display device 214.

Range finder component 202 can be configured to determine distance 204 to target 206, e.g., in connection with hunting or target shooting. Distance 204 can be determined in any suitable units, such as yards, meters, feet, or the like. Display device 214 can be, or can include, an optics or optical device such as a scope, an electronic or computer-based display such as a liquid crystal display (LCD), or another suitable display device. In some embodiments, display device 214 can be configured to provide a heads up display (HUD) type representation.

Camera device 208 can be configured to receive camera input 212 relating to field of view 210. Field of view 210 represents a view of an environment and generally includes target 206. Typically, camera input 212 will include visible light, however, it is understood that camera input 212 can also relate to electromagnetic radiation (EM) outside of the human-visible spectrum, such as, e.g., infra-red light.

Display device 214 can be configured to present various display output 224. For example, display device 214 can present a first output representative of distance 204 to target 206, which is illustrated by reference numeral 216. As another example, display device 214 can present a second output that can be representative of a portion of the field of view 210 that includes target 206, which is illustrated by reference numeral 218. Advantageously, the same display output presenting the first and second outputs (e.g., display output 224) can also present correction reticle 220. Correction reticle 220 can be configured to correct an aiming point based on the distance to the target or other suitable parameters.

In addition, display output 224 can include one or more correction element(s) 222, which is further detailed in connection with FIG. 5.

It is understood that in some embodiments, system 200 (and system 100) can include or be communicatively coupled to data store 226 and/or sensors 228. Sensors 228 can relate to devices employed to access or measure any suitable physical quantity such as, e.g., wind speed, wind direction, elevation, elevation of the target, air pressure, precipitation, firing angle, motion, and so on. Data store 226 can store sensor data as well as configuration data associated with an associated projectile device (e.g., bow, rifle) and various scientific principle data (e.g., gravitational constants, drag coefficients etc.) or unit conversion data. For example, with known quantities such as a draw weight for a bow, muzzle velocity for a rifle, and certain data associated with a type of ammunition or projectile, very precise determinations can be made for an expected trajectory of the projectile. This trajectory can, in turn, be used to determine correction element 222. In some embodiments, data store 226 can store factory specifications for projectile devices and projectiles to enable ready selection by a user. Thus, a user might simply select the type of arm and ammunition being used and associated quantities (e.g., muzzle velocity for that type of ammunition) can be looked up rather than input by the user.

Figure 3:
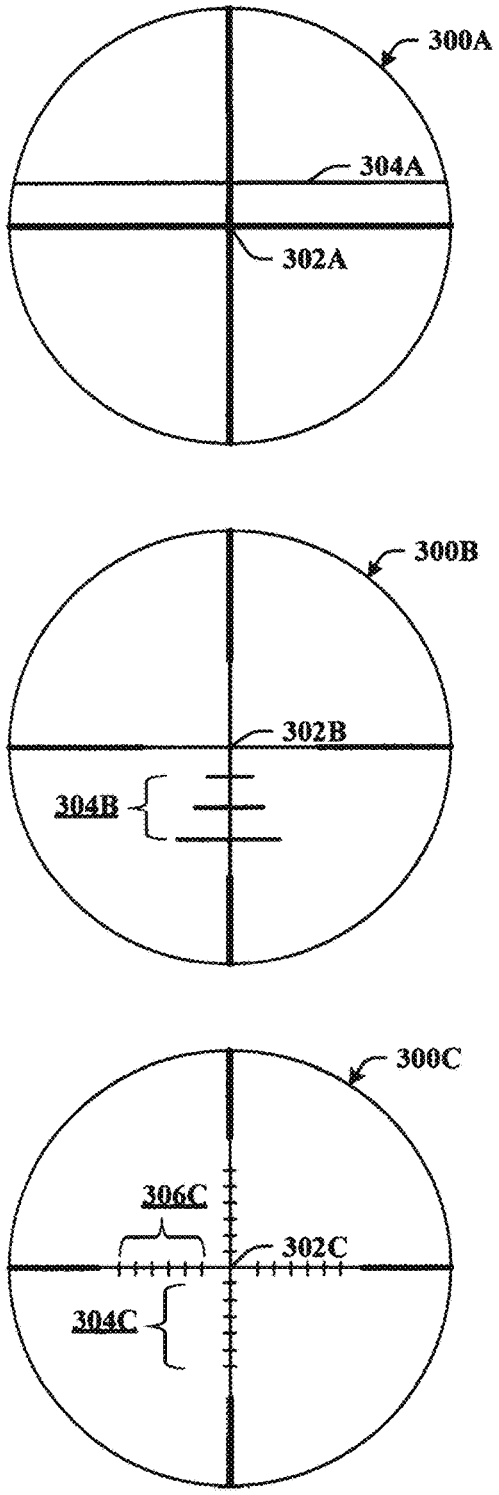
FIG. 3 illustrates various non-limiting example correction reticles in accordance with one or more embodiments of the disclosed subject matter.

Referring now to FIG. 3, various non-limiting example correction reticles are illustrated in accordance with one or more embodiments of the disclosed subject matter. Repetitive description of like elements employed in other embodiments described herein is omitted for sake of brevity. For example, reference numeral 300A depicts a first example reticle, reference numeral 300B depicts a second example reticle, and reference numeral 300C depicts a third example reticle. Correction reticles 300A-C can represent examples of reticle 120 of FIG. 1 or reticle 220 of FIG. 2. As detailed in connection with FIGS. 1 and 2, a display device (e.g., display device 110 or 214) can present, along with other suitable output, a correction reticle. This correction reticle can be configured to correct an aiming point based on the distance to the target.

The correction reticle can comprise a center element that can represent the aiming point at a default distance, examples of which are illustrated by reference numerals 302A-C. More generally, center element 302 can represent where a projectile will strike under zeroed or default conditions, which can be based on a configuration of an associated projectile device. For example, a compound bow having a certain draw weight may be zeroed to a distance of, e.g., 50 feet, whereas a hunting rifle may be zeroed at 500 feet. Hence, if the distance to the target (e.g., distance 104, 204) is approximately similar then center element 302 can be employed as the aiming point, but corrected otherwise.

To effectuate such, correction reticles 300 can comprise one or more vertical aiming elements, examples of which can be found at reference numerals 304A-C. Vertical aiming elements 304 can be distributed vertically on correction reticle 300 and can be selectable as the aiming point based on the distance to the target and a configuration (e.g., type, characteristics, features, etc.) of a projectile device, and potentially based on other elements as well.

In some embodiments, a difference between a first element of vertical aiming elements 304 and a second element of vertical aiming elements 304 can be representative of a milliradian, which is also referred to herein as a 'mil' or 'mil-dot'. Hence, selecting the first aiming element (e.g., instead of center element 302) as the aiming point can use known geometrical relationships to correct the expected point of impact of a projectile for different distances to the target.

In some embodiments, correction reticle 300 can further comprise one or more horizontal aiming elements, an example of which is provided in connection with reference numeral 306C. Horizontal aiming elements 306C can be distributed horizontally on correction reticle 300 and can be selectable as the aiming point based on an offset indicator (not shown, but see elements 506 and 508 of FIG. 5), the distance to the target, and the configuration of the projectile device. In some embodiments, a difference between a first element of horizontal aiming elements 306C and a second element of horizontal aiming elements 306C can be representative of a milliradian.

Figure 4:
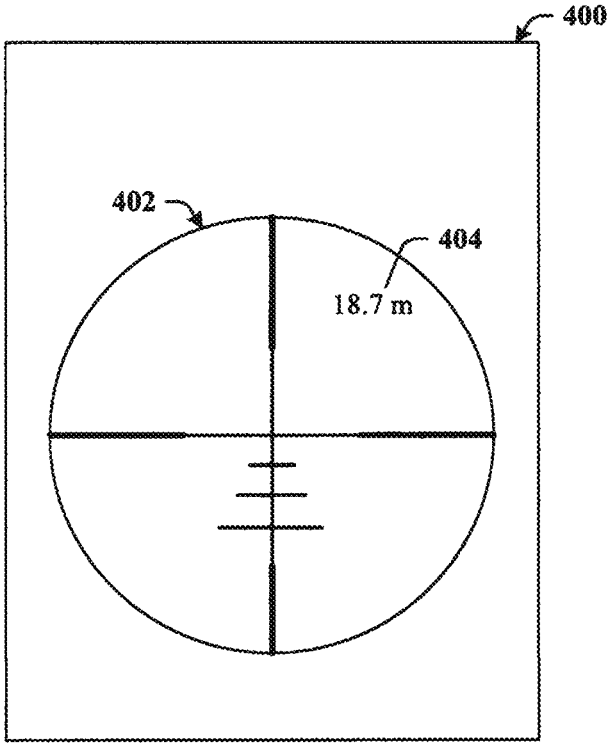
FIG. 4 illustrates an example output device that can present of a first example output of a display device in accordance with one or more embodiments of the disclosed subject matter.

Referring now to FIG. 4, output device 400 is provided. Output device 400 can present of a first example output (e.g., display output 114 or 224) of a display device in accordance with one or more embodiments of the disclosed subject matter. Repetitive description of like elements employed in other embodiments described herein is omitted for sake of brevity. In this example, output device 400 can be graphical user interface or other suitable output device. Display device can present correction reticle 402 having a center element 404 and an output 406 representative of a distance to the target (e.g., distance 104 or 204).

Figure 5:
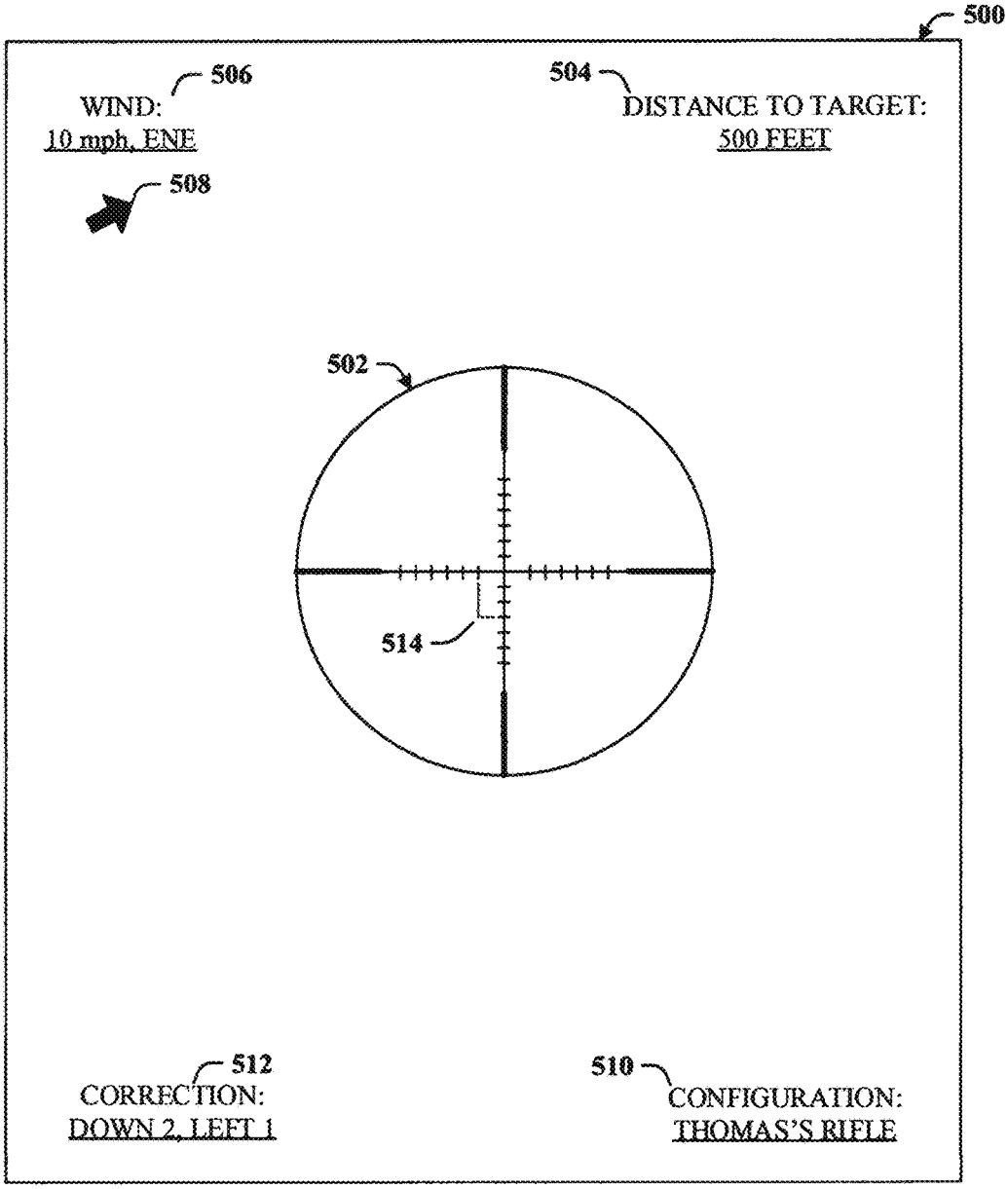
FIG. 5 depicts an example output device that can present of a second example output of a display device in accordance with one or more embodiments of the disclosed subject matter.

Turning now to FIG. 5, output device 500 is provided. Output device 500 can present of a second example output (e.g., display output 114 or 224) of a display device in accordance with one or more embodiments of the disclosed subject matter. Repetitive description of like elements employed in other embodiments described herein is omitted for sake of brevity. In this example, output device 500 can be graphical user interface or other suitable output device. Display device can present correction reticle 502 having a center element and an output 504 representative of a distance to the target (e.g., distance 104 or 204).

As noted previously, in some embodiments, display device 500 can present an offset indicator, an example of which can be wind velocity (e.g., both direction and magnitude) or speed, or another ambient or environment parameter. In this example, the wind is determined to be 10 mph with a direction of East-Northeast, as illustrated by reference numeral 506. Additionally or alternatively, such information can be presented graphically as illustrated by reference numeral 508. The arrow can illustrate wind direction, which can be relative to a salient direction of output device 500 and/or an associated projectile device. In some embodiments, a magnitude of the wind can be illustrated by a size or length of the arrow.

It is understood that while wind velocity is used as an example, other data or measurements might also be suitable. For instance, in this example, a user might determine, based on output 504 (e.g., distance to target) that a vertical correction is necessary based on the distance. Likewise, the user might determine that a horizontal correction is required based on offset elements 506 or 508, such as wind velocity or another parameter. Such can be based on a configuration 510 of the projectile device. In some embodiments, configuration 510 can be presented by output device 500. In some embodiments, configuration 510 can be selected from a list of known projectile device and/or configured based on any suitable procedure.

In some embodiments, range finder device 100 or 200 can comprise a computation component that can be configured to compute a correction element 512. Correction element 512 can identify the vertical aiming element to be selected as the aiming point, which can be based on the distance to the target and the configuration of the projectile device. For example, given that the distance if 500 feet, and given that it is known that "Thomas's Rifle" is being used (e.g., with a known muzzle velocity, etc.), then vertical corrections can be readily determined. In this case, a correction equivalent to two milliradians can be determined. Similarly, given that wind velocity is known to be 10 mph, ENE, then horizontal corrections can be determined. In this case a correction equivalent to one milliradian.

In some embodiments, correction element 512 can be graphically presented such as changing the color of the mil dots representing the calculated correction to red or the like or presenting graphical representation 514.

EXAMPLE METHODS

Figure 6:
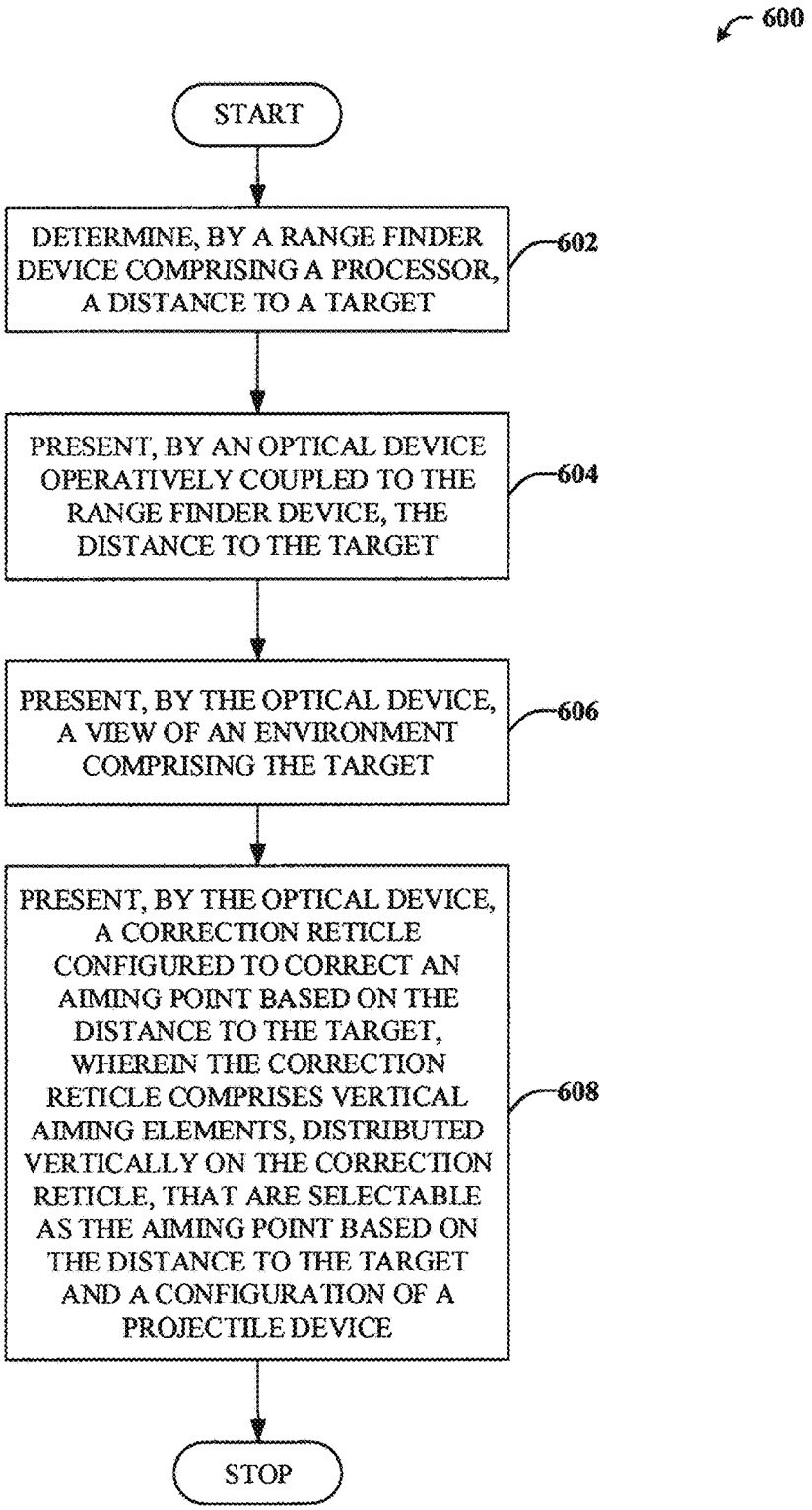
FIG. 6 depicts an example methodology for utilizing a range finder with an integrated correction reticle is provided in accordance with one or more embodiments of the disclosed subject matter.

FIG. 6 illustrates a methodology in accordance with the disclosed subject matter. While, for purposes of simplicity of explanation, methodologies are shown and described as a series of acts, it is to be understood and appreciated that the disclosed subject matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the disclosed subject matter. Additionally, it should be further appreciated that the methodologies disclosed hereinafter and throughout this specification are capable of being stored on an article of manufacture to facilitate transporting and transferring such methodologies to computers.

Turning now to FIG. 6, example method 600 for utilizing a range finder with an integrated correction reticle is provided in accordance with one or more embodiments of the disclosed subject matter. In general, at reference numeral 602, a distance to a target can be determined. The distance can be determined by a range finder component or device, and associated distance data can be stored or received.

Next to be described, at reference numeral 604, an optical device that is operatively coupled to the range finder device can be employed to present the distance to the target. At reference numeral 606, the optical device can present a view of an environment comprising the target.

At reference numeral 608, the optical device can present a correction reticle. The correction reticle can be configured to correct an aiming point based on the distance to the target. The correction reticle can comprise one or more vertical aiming elements, which can be distributed vertically on the correction reticle. The vertical aiming elements can be selectable as the aiming point based on the distance to the target and a configuration of a projectile device

EXAMPLE OPERATING ENVIRONMENTS

The systems and processes described below can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated herein.

Figure 7:
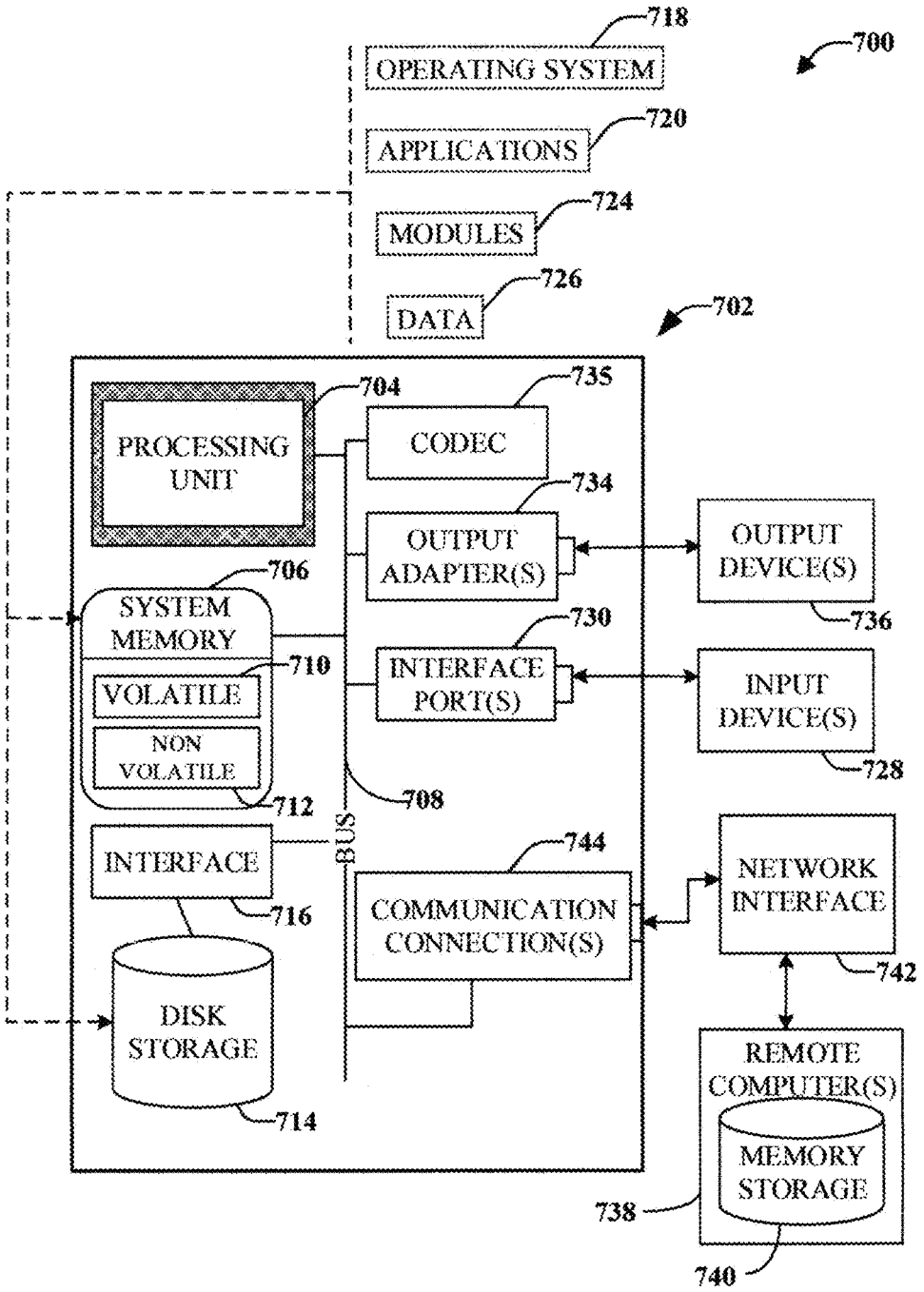
FIG. 7 illustrates an example schematic block diagram for a computing environment in accordance with certain embodiments of this disclosure.

With reference to FIG. 7, a suitable environment 700 for implementing various aspects of the claimed subject matter includes a computer 702. The computer 702 includes a processing unit 704, a system memory 706, a codec 735, and a system bus 708. The system bus 708 couples system components including, but not limited to, the system memory 706 to the processing unit 704. The processing unit 704 can be any of various available processors. Dual microprocessors and other multiprocessor architectures also can be employed as the processing unit 704.

The system bus 708 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI) or others now in existence or later developed.

The system memory 706 includes volatile memory 710 and non-volatile memory 712. The basic input/output system (BIOS), containing the basic routines to transfer information between elements within the computer 702, such as during start-up, is stored in non-volatile memory 712. In addition, according to present innovations, codec 735 may include at least one of an encoder or decoder, wherein the at least one of an encoder or decoder may consist of hardware, software, or a combination of hardware and software. Although, codec 735 is depicted as a separate component, codec 735 may be contained within non-volatile memory 712 or included in other components detailed herein. By way of illustration, and not limitation, non-volatile memory 712 can include read only memory (ROM), programmable ROM (PROM), electrically programmable ROM (EPROM), electrically erasable programmable ROM (EEPROM), or flash memory. Volatile memory 710 includes random access memory (RAM), which acts as external cache memory. According to present aspects, the volatile memory may store the write operation retry logic (not shown in FIG. 7) and the like. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM), resistive RAM (RRAM), or others now in existence or later developed.

Computer 702 may also include removable/non-removable, volatile/non-volatile computer storage medium. FIG. 7 illustrates, for example, disk storage 714. Disk storage 714 includes, but is not limited to, devices like a magnetic disk drive, solid state disk (SSD) floppy disk drive, tape drive, flash memory card, or memory stick. In addition, disk storage 714 can include storage medium separately or in combination with other storage medium including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 714 to the system bus 708, a removable or non-removable interface is typically used, such as interface 716. It is appreciated that storage devices 714 can store information related to a user. Such information might be stored at or provided to a server or to an application running on a user device. In one embodiment, the user can be notified (e.g., by way of output device(s) 736) of the types of information that are stored to disk storage 714 and/or transmitted to the server or application. The user can be provided the opportunity to opt-in or opt-out of having such information collected and/or shared with the server or application (e.g., by way of input from input device(s) 728).

It is to be appreciated that FIG. 7 describes software that acts as an intermediary between users and the basic computer resources described in the suitable operating environment 700. Such software includes an operating system 718. Operating system 718, which can be stored on disk storage 714, acts to control and allocate resources of the computer system 702. Applications 720 take advantage of the management of resources by operating system 718 through program modules 724, and program data 726, such as the boot/shutdown transaction table and the like, stored either in system memory 706 or on disk storage 714. It is to be appreciated that the claimed subject matter can be implemented with various operating systems or combinations of operating systems.

A user enters commands or information into the computer 702 through input device(s) 728. Input devices 728 include, but are not limited to, a pointing device such as a mouse, stylus, touch pad, keyboard, microphone, joystick, game pad, satellite dish, scanner, TV tuner card, digital camera, digital video camera, web camera, and the like. These and other input devices connect to the processing unit 704 through the system bus 708 via interface port(s) 730. Interface port(s) 730 include, for example, a serial port, a parallel port, a game port, and a universal serial bus (USB). Output device(s) 736 use some of the same type of ports as input device(s) 728. Thus, for example, a USB port may be used to provide input to computer 702 and to output information from computer 702 to an output device 736. Output adapter 734 is provided to illustrate that there are some output devices 736 like monitors, speakers, and printers, among other output devices 736, which require special adapters. The output adapters 734 include, by way of illustration and not limitation, video and sound cards that provide a means of connection between the output device 736 and the system bus 708. It should be noted that other devices and/or systems of devices provide both input and output capabilities such as remote computer(s) 738.

Computer 702 can operate in a networked environment using logical connections to one or more remote computers, such as remote computer(s) 738. The remote computer(s) 738 can be a personal computer, a server, a router, a network PC, a workstation, a microprocessor based appliance, a peer device, a smart phone, a tablet, or other network node, and typically includes many of the elements described relative to computer 702. For purposes of brevity, only a memory storage device 740 is illustrated with remote computer(s) 738. Remote computer(s) 738 is logically connected to computer 702 through a network interface 742 and then connected via communication connection(s) 744. Network interface 742 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDD, Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 744 refers to the hardware/software employed to connect the network interface 742 to the bus 708. While communication connection 744 is shown for illustrative clarity inside computer 702, it can also be external to computer 702. The hardware/software necessary for connection to the network interface 742 includes, for exemplary purposes only, internal and external technologies such as, modems including regular telephone grade modems, cable modems and DSL modems, ISDN adapters, and wired and wireless Ethernet cards, hubs, and routers.

Figure 8:
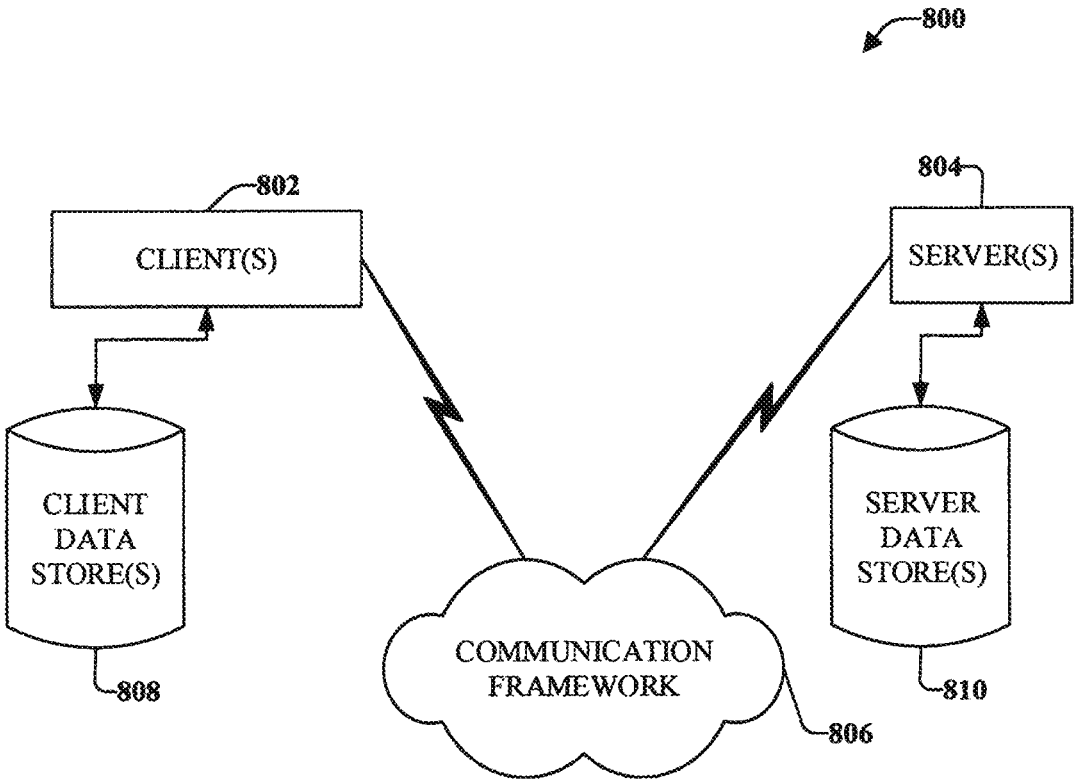
FIG. 8 illustrates an example block diagram of a computer operable to execute certain embodiments of this disclosure.

Referring now to FIG. 8, there is illustrated a schematic block diagram of a computing environment 800 in accordance with this specification. The system 800 includes one or more client(s) 802 (e.g., laptops, smart phones, PDAs, media players, computers, portable electronic devices, tablets, and the like). The client(s) 802 can be hardware and/or software (e.g., threads, processes, computing devices). The system 800 also includes one or more server(s) 804. The server(s) 804 can also be hardware or hardware in combination with software (e.g., threads, processes, computing devices). The servers 804 can house threads to perform transformations by employing aspects of this disclosure, for example. One possible communication between a client 802 and a server 804 can be in the form of a data packet transmitted between two or more computer processes wherein the data packet may include video data. The data packet can include a cookie and/or associated contextual information, for example. The system 800 includes a communication framework 806 (e.g., a global communication network such as the Internet, or mobile network(s)) that can be employed to facilitate communications between the client(s) 802 and the server(s) 804.

Communications can be facilitated via a wired (including optical fiber) and/or wireless technology. The client(s) 802 are operatively connected to one or more client data store(s) 808 that can be employed to store information local to the client(s) 802 (e.g., cookie(s) and/or associated contextual information). Similarly, the server(s) 804 are operatively connected to one or more server data store(s) 810 that can be employed to store information local to the servers 804.

In one embodiment, a client 802 can transfer an encoded file, in accordance with the disclosed subject matter, to server 804. Server 804 can store the file, decode the file, or transmit the file to another client 802. It is to be appreciated, that a client 802 can also transfer uncompressed file to a server 804 and server 804 can compress the file in accordance with the disclosed subject matter. Likewise, server 804 can encode video information and transmit the information via communication framework 806 to one or more clients 802.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described herein can include electrical circuit(s) that can include components and circuitry elements of suitable value in order to implement the embodiments of the subject innovation(s). Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the subject innovation are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize. Moreover, use of the term "an embodiment" or "one embodiment" throughout is not intended to mean the same embodiment unless specifically described as such.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the herein illustrated exemplary aspects of the claimed subject matter. In this regard, it will also be recognized that the innovation includes a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of skill in the art.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable medium; or a combination thereof.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used herein differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

What is claimed is:

1. An integrated device, comprising:

a range finder device configured to determine a distance to a target in a field of view; and a sight device that operates to aim a projectile device that is coupled to the integrated device, wherein the sight device comprises a display device configured to present:

a first output representative of the distance to the target;

a second output representative of image data received from a camera device, wherein the image data depicts a portion of the field of view that includes the target; and a correction reticle configured to correct an aiming point based on the distance to the target, wherein the correction reticle comprises a center element representing the aiming point at a default distance and vertical aiming elements, distributed vertically on the correction reticle, that are selectable as the aiming point based on the distance to the target and a configuration of the projectile device.

2. The integrated device of claim 1, wherein a difference between a first element of the vertical aiming elements and a second element of the vertical aiming elements is representative of a milliradian.

3. The integrated device of claim 1, wherein the correction reticle comprises horizontal aiming elements, distributed horizontally on the correction reticle, that are selectable as the aiming point based on an offset indicator, the distance to the target, and the configuration of the projectile device.

4. The integrated device of claim 3, wherein a difference between a first element of the horizontal aiming elements and a second element of the horizontal aiming elements is representative of a milliradian.

5. The integrated device of claim 3, wherein the display device is configured to present a third output representative of the offset indicator.

6. The integrated device of claim 3, wherein the offset indicator is based on a determined wind velocity.

7. The integrated device of claim 1, further comprising a camera device configured to generate the image data representative of the field of view.

8. The integrated device of claim 1, further comprising a computation component that computes a correction element, wherein the correction element identifies the vertical aiming element to be selected as the aiming point based on the distance to the target and the configuration of the projectile device.

9. The integrated device of claim 8, wherein the display device is configured to present a fourth output representative of the correction element.

10. The integrated device of claim 1, further comprising a mounting component configured to attach the range finder device to the projectile device.

11. A method for presenting aiming data, comprising:

determining, by range finder device comprising a processor, a distance to a target of a coupled projectile device;

presenting, by an optical device operatively coupled to the range finder device, the distance to the target;

presenting, by the optical device, image data received from a camera device, wherein the image data depicts a view of an environment comprising the target; and presenting, by the optical device, a correction reticle configured to correct an aiming point based on the distance to the target, wherein the correction reticle comprises vertical aiming elements, distributed vertically on the correction reticle, that are selectable as the aiming point based on the distance to the target and a configuration of the projectile device.

12. The method of claim 11, wherein a difference between a first element of the vertical aiming elements and a second element of the vertical aiming elements is representative of a milliradian.

13. An aiming device, comprising:

a projectile device configured to propel a projectile in response to activation of a triggering mechanism; and a range finder device, operatively coupled to the projectile device, configured to determine a distance to a target, the range finder device comprising:

a camera device configured to receive camera input of a field of view that includes the target; and a display device configured to present:

a first output representative of the distance to the target;

a second output representative of a portion of the field of view that includes the target; and a third output representative of a correction reticle configured to correct an aiming point based on the distance to the target, wherein the correction reticle comprises vertical aiming elements, distributed vertically on the correction reticle, that are selectable as the aiming point based on the distance to the target and a configuration of a projectile device.

14. The aiming device of claim 13, wherein a difference between a first element of the vertical aiming elements and a second element of the vertical aiming elements is representative of a milliradian.

15. The aiming device of claim 13, wherein the correction reticle comprises horizontal aiming elements, distributed horizontally on the correction reticle, that are selectable as the aiming point based on an offset indicator, the distance to the target, and the configuration of the projectile device.

16. The aiming device of claim 13, wherein the display device is configured to present a fourth output representative of the offset indicator.

17. The aiming device of claim 16, wherein a difference between a first element of the horizontal aiming elements and a second element of the horizontal aiming elements is representative of a milliradian.

* * * * *